US005150889A

United States Patent [19]

Taguchi

[11] Patent Number: 5,150,889

[45] Date of Patent: Sep. 29, 1992

[54] SORTER FOR STAPLING

[75] Inventor: Keiichi Taguchi, Kuse, Japan

[73] Assignee: Mita Industrial Co., Ltd., Osaka, Japan

[21] Appl. No.: 779,302

[22] Filed: Oct. 17, 1991

[30] Foreign Application Priority Data

Oct. 17, 1990 [JP] Japan ..... 2-279687
Oct. 17, 1990 [JP] Japan ..... 2-279688

[51] Int. Cl.[5] ..... B42B 1/02
[52] U.S. Cl. ..... 270/53; 270/52
[58] Field of Search ..... 270/53, 37, 52, 58

[56] References Cited

FOREIGN PATENT DOCUMENTS 147295 6/1990 Japan ..... 270/53
276693 11/1990 Japan ..... 270/53
49995 3/1991 Japan ..... 270/53

OTHER PUBLICATIONS

Patent Abstracts of Japan, vol. II, No. 266 (M-620)(2713), Aug. 28, 1977, & JP-A-62 070 167 (Sharp) Mar. 31, 1987.
Patent Abstracts of Japan, vol. 10, No. 368 (M-543)(2425) Dec. 9, 1986, & JP-A-61 162 463 (Canon) Jul. 23, 1986.
Patent Abstracts of Japan, vol. 12, No. 386 (M-754)(3233) Oct. 14, 1988 & JP-A-63 139 879 (Mita) Jun. 11, 1988.

*Primary Examiner*—Edward K. Look
*Assistant Examiner*—Therese M. Newholm
*Attorney, Agent, or Firm*—Antonelli, Terry, Stout & Kraus

[57] ABSTRACT

A sorter for stapling is provided with an arrangement of a plurality of sorting bins and a paper guide means which discharges the papers to predetermined bins. A stapling means is provided to move to the positions corresponding to the predetermined bins. The stapling means moves to a position corresponding to a bin in which are held the papers to be stapled among the predetermined bins, and effects the stapling process under the condition where the papers are held in said bin. The stapling number setting means sets the number of bins in which are held the papers that are to be stapled. A control means is provided which, after the papers are discharged to the predetermined bins by the paper guide means, causes the stapling means to effect the stapling process for only those papers that are held in the bins of a number corresponding to the number of said bins.

9 Claims, 6 Drawing Sheets

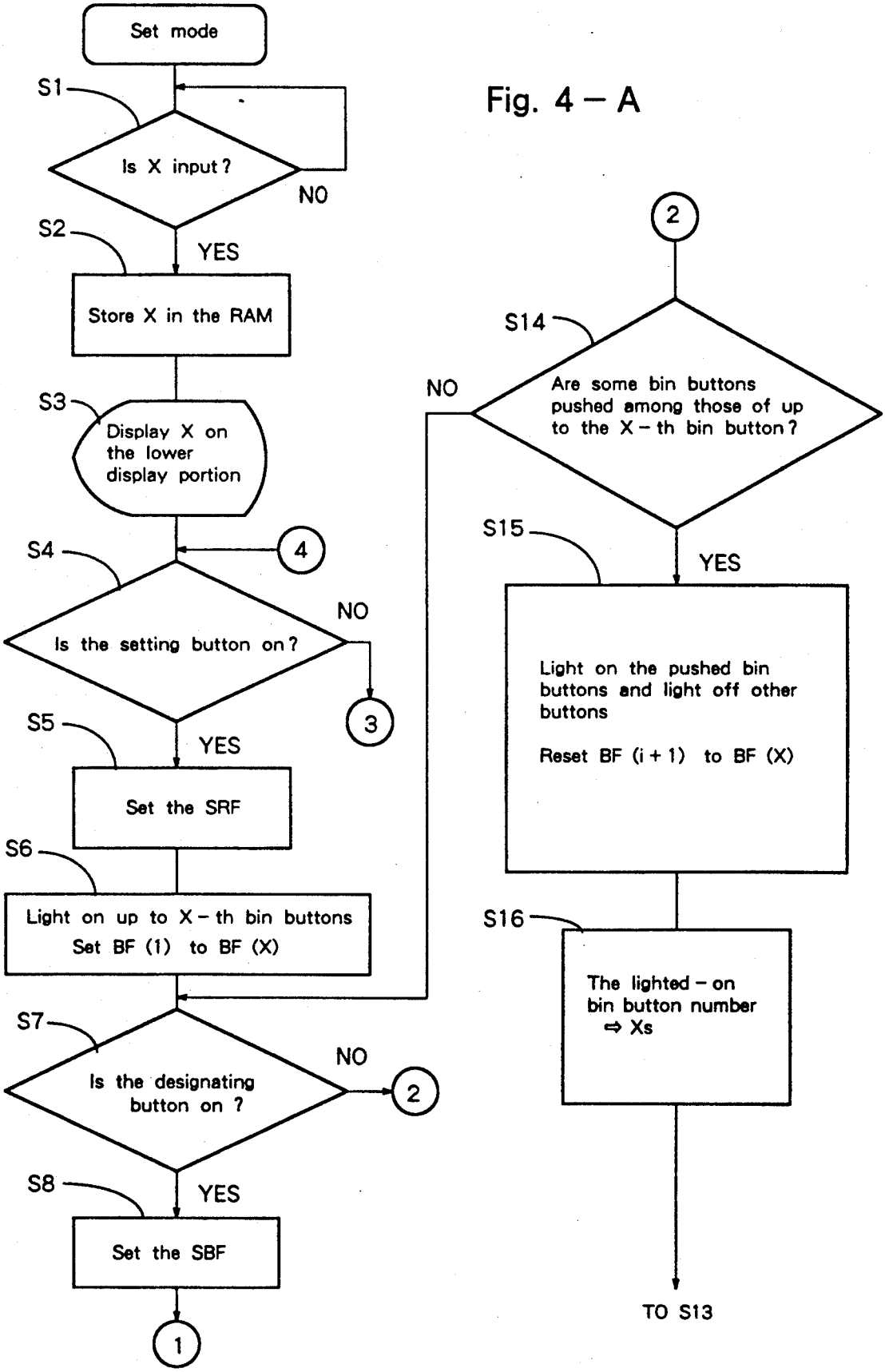
Fig. 4 – A

Fig. 4 – B
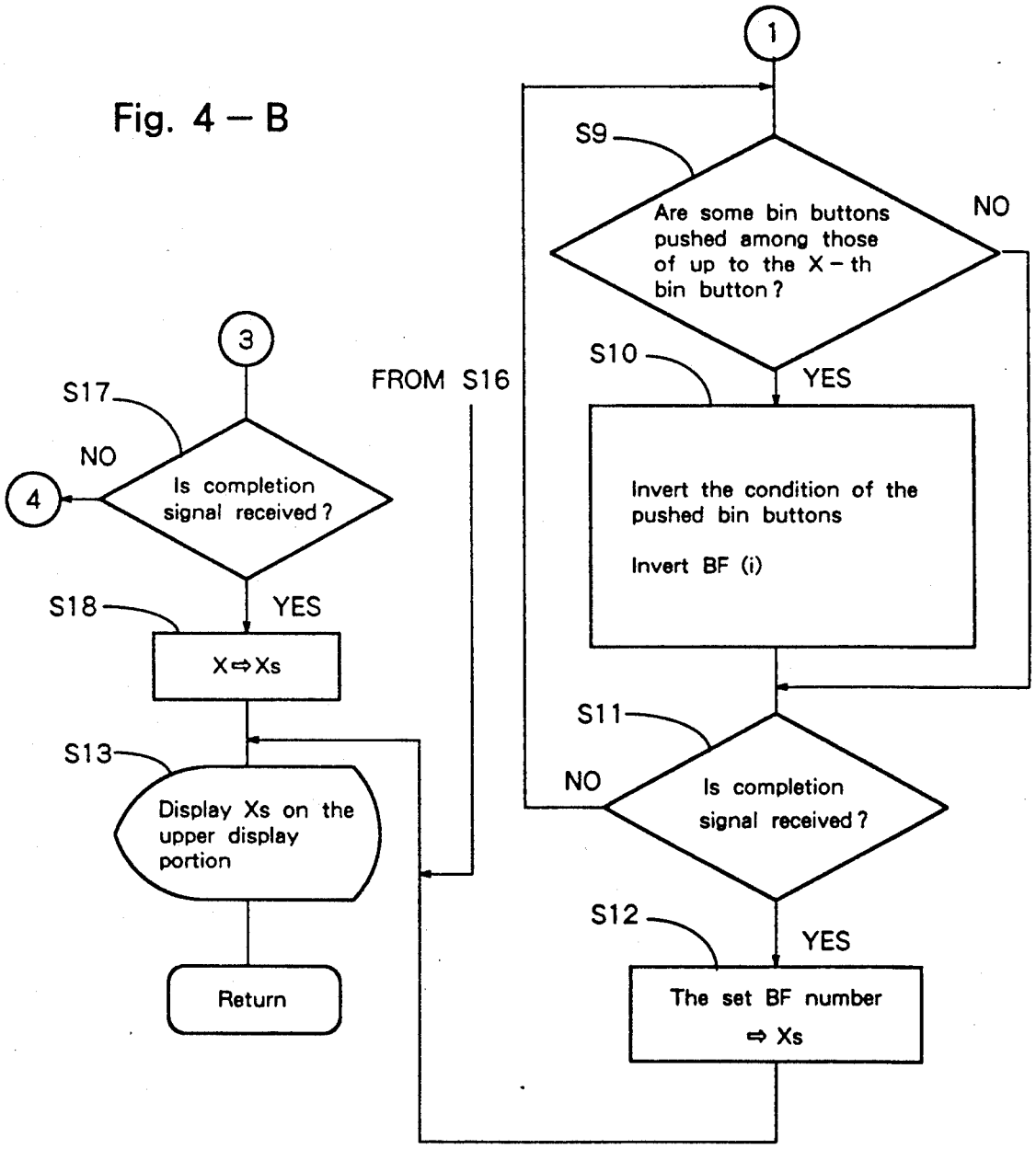

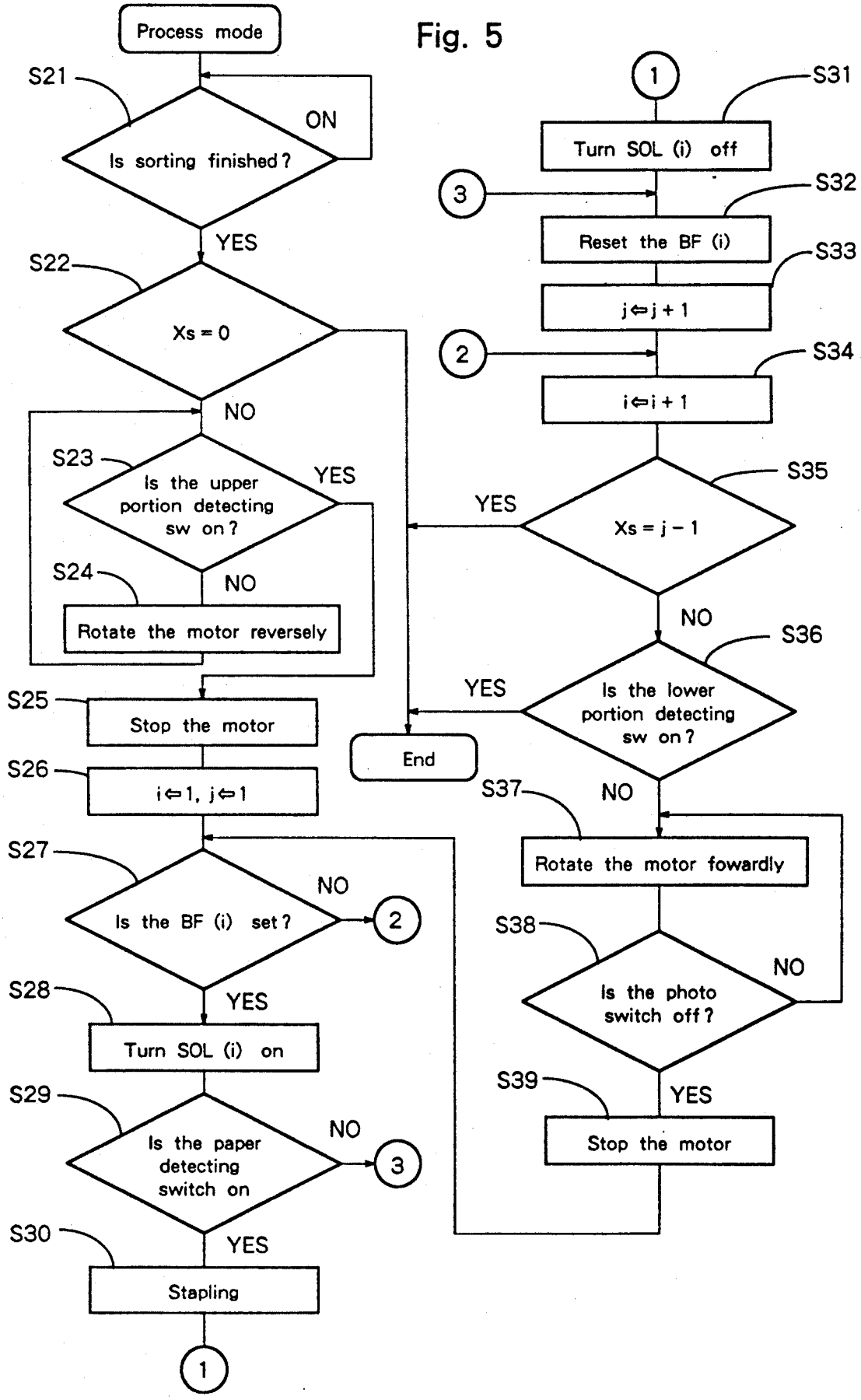
Fig. 5
Process mode
S21
Is sorting finished?
ON
YES
S22
Xs = 0
NO
S23
Is the upper portion detecting sw on?
YES
NO
S24
Rotate the motor reversely
S25
Stop the motor
S26
i⇐1, j⇐1
S27
Is the BF (i) set?
NO
2
YES
S28
Turn SOL (i) on
S29
Is the paper detecting switch on
NO
3
YES
S30
Stapling
1
1
S31
Turn SOL (i) off
3
S32
Reset the BF (i)
S33
j⇐j + 1
2
S34
i⇐i + 1
S35
Xs = j − 1
YES
NO
S36
Is the lower portion detecting sw on?
YES
NO
End
S37
Rotate the motor fowardly
S38
Is the photo switch off?
NO
YES
S39
Stop the motor

SORTER FOR STAPLING

FIELD OF THE INVENTION

The present invention relates to a sorter for stapling which is mounted on an image-forming device such as a copying machine and the like, and which classifies copied or printed papers discharged from the image-forming device into predetermined categories and then staples the thus classified papers.

DESCRIPTION OF THE PRIOR ART

A sorter for stapling has been widely known that can be mounted on an image-forming device such as a copying machine and the like. The conventional sorter for stapling is capable of sorting and classifying copied or printed papers (hereinafter simply referred to as papers or copies) discharged from the image-forming device and then, automatically stapling the papers thus arranged into the order of pages. For instance, according to Japanese Laid-Open Patent Publication No. 139877/1988, the sorter with a finisher is constituted in such a manner that it can be set in advance to so work that among the papers that are distributed and held in the bins of the sorting portion, only given numbers of copies are stapled and the remaining copies are simply sorted but are not stapled. Therefore, the above conventional sorter with a finisher gives a merit in that two kinds of papers, i.e., the papers that need be only sorted and the papers that need be sorted and then stapled, can be obtained through one time of processing, so that the operation is facilitated.

However, the above conventional sorter with the finisher involves the following problems that must be solved.

(1) Among, the papers distributed to a plurality of bins, those papers that are to be stapled are, first, carried from a predetermined bin to a stapling portion that has a stapling means and where the stapling process is carried out. The stapled papers are stacked and held in a stack portion that is provided separately from the bins, while the papers that are simply sorted but are not stapled remain on the bins. The stapled papers are taken out from the stack portion, whereas the papers that are simply sorted are taken out from the stack portion, whereas the papers that are simply sorted are taken out from the bins of the sorting portion. Namely, these two kinds of documents must be taken out from the separate places, involving cumbersome operation for taking out. Moreover, there is a likelihood of forgetting to take out the papers of either kind.

(2) The stapling process is carried out based on a means which sets the number of copies to be held with staple and a means which counts the number of times of stapling processes. That is, if the number of copies to be held is set by the above setting means, given number of copies only are subjected to the stapling process in sequence from the first bins, among the copies that are distributed and held in the bins of the sorting portion. Therefore, it is not possible to designate optional bins and to effect the stapling process for only those papers that are held in the designated bins.

SUMMARY OF THE INVENTION

It is the first object of the present invention to provide an improved sorter for stapling which makes it possible to obtain two kinds of papers, i.e., the papers that are simply sorted and the papers that are sorted and stapled through one time of processing, the stapled papers and the papers only sorted being obtained in a condition where the papers are held in the sorting bins.

It is the second object of the present invention to provide an improved sorter for stapling which is capable of optionally designating any bin(s) and of effecting the stapling process for the papers held in the designated bin(s) only.

It is the third object of the present invention to provide an improved sorter for stapling which is capable effecting the stapling process while setting the number of bins that are to be subjected to the stapling process and also designating the bin(s) that are to be subjected to the stapling process.

In order to achieve the above first object, the present invention is to provide a sorter for stapling comprising;

- a plurality of sorting bins arranged to hold copied papers therein;
- a paper guide means which discharges the papers to predetermined bins in response to the setting of the sorting process mode and the number of copies to be sorted;
- a stapling means which is capable of being moved to the positions that correspond to the predetermined bins, moves to a position that corresponds to a bin in which are held the papers that are to be stapled, and effects the stapling process under the condition where the papers are held in said bin;
- a stapling number setting means that sets the number of bins in which are held the papers to be stapled by said stapling means; and
- a control means which causes said stapling means to effect the stapling process for only those papers that are held in the bins of a number corresponding to the number of the bins set by said stapling number setting means after the papers have been discharged to said predetermined bins by said paper guide means.

In order to achieve the above second object, the present invention is to provide a sorter for stapling comprising:

- a plurality of sorting bins arranged to hold copied papers therein;
- a paper guide means which discharges the papers to predetermined bins in response to the setting of the sorting process mode and the number of copies to be sorted;
- a stapling means which is capable of being moved to the positions that correspond to the predetermined bins, moves to a position that corresponds to a bin in which are held the papers that are to be stapled, and effects the stapling process under the condition where the papers are held in said bin;
- a stapling bin designating means that designates a bin in which are held the papers to be stapled by said stapling means; and
- a control means which causes said stapling means to effect the stapling process for only those papers that are held in the bin designated by said stapling bin designating means after the papers have been discharged to said predetermined bins by said paper guide means.

In order to achieve the above third object, the present invention is to provide a sorter for

- a plurality of sorting bins arranged to hold copied papers therein;

a paper guide means which discharges the papers to predetermined bins in response to the setting of the sorting process mode and the number of copies to be sorted;

a stapling means which is capable of being moved to the positions that correspond to the predetermined bins, moves to a position that corresponds to a bin in which are held the papers that are to be stapled, and effects the stapling process under the condition where the papers are held in said bin;

a stapling number setting means that sets the number of bins in which are held the papers to be stapled by said stapling means;

a stapling bin designating means that designates a bin in which are held the papers to be stapled by said stapling means; and a control means which selectively causes said stapling means to effect the stapling process for only those papers that are held in the bins of a number corresponding to the number of the bins set by said stapling number setting means or to effect the stapling process for only those papers that are held in the bin(s) designated by said stapling bin designating means, after the papers have been discharged to said predetermined bins by said paper guide means.

BRIEF DESCRIPTION OF THE DRAWING

FIG. 4-A and FIG. 4-B are a flow chart which illustrates the control operation of the sorter for stapling in the stapling set mode; and FIG. 5 is a flow chart which illustrates the control operation of the sorter for stapling in the stapling process mode.

DETAILED DESCRIPTION OF THE PREFERRED EMBODIMENTS

A sorter for stapling coupled to a copying machine, provided by the present invention, will be described with reference to the accompanying drawings.

Figure 1:
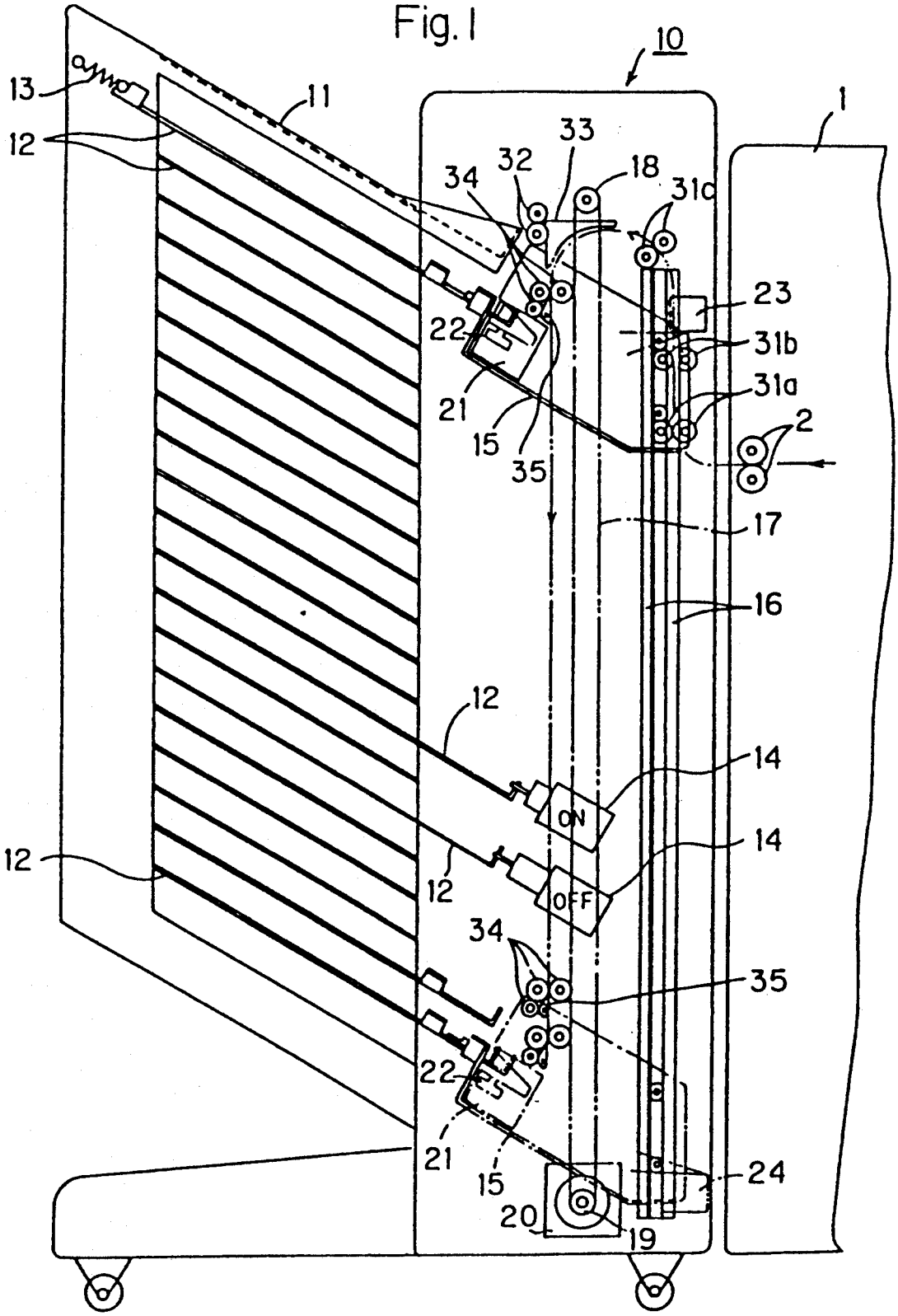
FIG. 1 is a sectional view which schematically illustrates the constitution of a sorter for stapling according to an embodiment of the present invention.

FIG. 1 is a sectional view which schematically illustrates the constitution of a sorter for stapling 10 according to an embodiment of the present invention.

The sorter for stapling 10 is equipped with a non-sorting bin 11 disposed, for example, at the uppermost portion and sorting bins 12 in a number of, for example, twenty arranged thereunder at predetermined intervals. The sorting bins are hereinafter simply referred to as bins. Tension coiled spring 13 is fastened to the top end of each of the bins 12 (left side in the drawing or downstream side in a direction in which the papers are discharged) to pull the bin 12 toward the top end thereof at all times. Though the drawing illustrates only one tension coiled spring fastened to the uppermost bin 12, it should be noted that the tension coiled springs which are not shown are likewisely fastened to the other remaining bins 12.

Further, solenoid 14 is coupled to the root of each of the bins 12 (right side in the drawing or upstream side in the direction in which the papers are discharged). The solenoid 14 is secured to, for example, the frame of the sorter for stapling 10. When the solenoid 14 is under the "off" condition, the bin 12 is positioned being pulled toward the top end thereof by the tension coiled spring 13, as shown by the fifteenth bin 12. When the solenoid 14 is "on," on the other hand, the root portion of the bin 12 is pulled aslant downwards toward the right by the solenoid 14; i.e., the bin 12 is positioned being pulled toward the root direction thereof, as shown by the thirteenth bin 12.

Though the drawing shows only those solenoids 14 that are coupled to the thirteenth bin 12 and the fifteenth bin 12 from the top bin, it should be noted that the solenoids are likewisely coupled to the root of other bins 12.

The sorter for stapling 10 is further provided with an elevator 15 that moves up and down. The elevator 15 is constituted to move while being guided by the guides 16 that are secured to, for example, the frame of the sorter for stapling 10. The elevator 15 is coupled to a drive belt 17 so as to move up and down. The drive belt 17 is wound-round between an upper pulley 18 and a lower pulley 19. An elevator motor 20 is coupled to the lower pulley 19. As the lower pulley 19 is rotated by the elevator motor 20, the drive belt 17 is driven and the elevator 15 moves up and down. Specifically, when the elevator motor 20 turns in the forward direction, the elevator 15 moves down and when the elevator motor 20 turns in the reverse direction, the elevator 15 moves up.

The elevator 15 is equipped with a stapler 21 which is a mechanism for stapling the rear end of the papers discharged into the bin 12. Specifically, the stapler 21 moves up and down with the elevator 15 and stops at a position corresponding to any optional bin 12. When the solenoid 14 coupled to the optional bin 12 is turned on under this condition to pull the bin 12 toward the root direction, it becomes possible to carry out the stapling process. The stapler 21 is equipped with a paper detecting switch 22 which works to actuate the stapler 21 only when there exist papers on the bin 12 as will be described later.

The sorter for stapling 10 is further equipped with an uppermost portion detecting switch 23 and a lowermost portion detecting switch 24 for the elevator 15. The uppermost portion detecting switch 23 detects that the elevator 15 is positioned at the uppermost portion and that the stapler 21 is ready to effect the stapling process for the papers held in the uppermost bin 12. The lowermost portion detecting switch 24 detects that the stapler 21 is ready to effect the stapling process for the papers held in the lowermost bin 12.

The elevator 15 inclusive of the stapler 21 and the paper detecting switch 22; the drive belt 17 that is a means for moving the elevator 15 along the guide 16; the upper pulley 18; the lower pulley 19; the elevator motor 20; the uppermost portion detecting switch 23; the lowermost portion detecting switch 24; a photo-interrupter switch 25 and a shaft 27 for switch that will be described later; tension coiled springs 13 provided for the bins 12; and solenoids 14 are all included in the stapling means. As mentioned earlier, the stapling means is allowed to move to the position corresponding to a bin 12, i.e., moves to the position corresponding to a bin 12 in which are held the papers that are to be stapled, and effects the stapling process under the condition where the papers are held in this bin 12.

Like the ordinary sorter, furthermore, the sorter for stapling 10 is equipped with a paper guide means which guides and distributes the papers discharged by the paper discharge roller 2 of the copying machine body 1 into predetermined bins 12 in accordance with the sorting process mode and the number of copies to be sorted that are set on the side of the copying machine body 1. The paper guide means is constituted by guide rollers 31*a*, 31*b*, 31*c*, a paper discharge roller 32, a change-over pawl 33, guide rollers 34 provided for each of the bins 12, and a change-over pawl 35. When the sorting process mode is not set, the papers discharged by the roller 2 of the copying machine body 1 are discharged onto the non-sorting bin 11.

Figure 2:
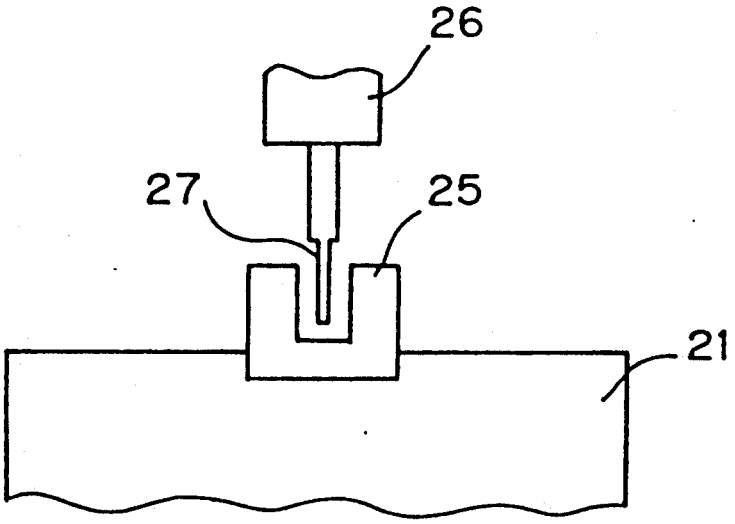
FIG. 2 is a diagram illustrating an example of the constitution for detecting the positional relationship between a stapler and a sorting bin.

A shown in FIG. 2, the sorter for stapling 10 is further provided with a photo-interrupter switch 25 on the side of the stapler 21, and the shaft 27 for switch is provided on the root portion of each bin 12 via a deflecting pawl 26. When the stapler 21 is located at a position corresponding to a predetermined bin 12, the shaft 27 for switch provided for the bin 12 turns the photo-interrupter switch 25 off, whereby it is detected that the stapler 21 is located at a position corresponding to the bin 12.

Figure 3:
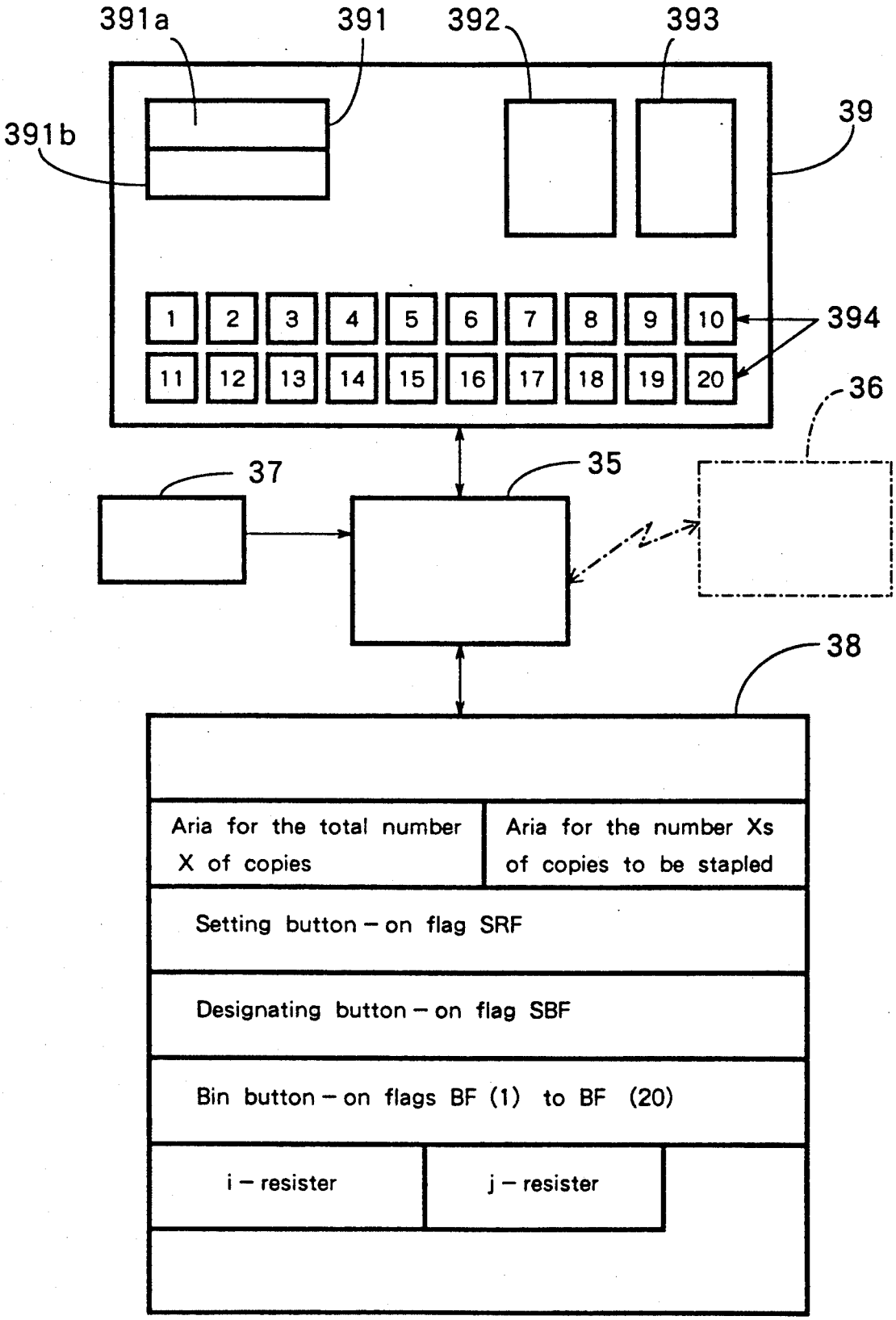
FIG. 3 is a block diagram showing a control circuit for the sorter for stapling according to the embodiment of the present invention.

FIG. 3 is a block diagram illustrating the constitution of a circuit which controls the sorter for stapling 10 according to this embodiment. The sorter for stapling 10 is equipped with a CPU 35 that works as a control center. When the sorter for stapling 10 is coupled to the copying machine body 1, the CPU 35 on the side of the sorter for stapling 10 is connected to the CPU 36 of the side of the copying machine body 1 and receives the control data and control instructions from the CPU 36 of the side of the copying machine body 1.

To the CPU 35 on the side of the sorter for stapling 10 are connected a ROM 37 which stores operation programs, a RAM 38 which temporarily stores various flags, registers and data necessary for control that will be described later, and an operation panel 39.

The operation panel 39 is disposed at a position where it can be easily operated by the user, for example, on the upper surface of the sorter for stapling 10. The operation panel 39 is provided with a display panel 391 having an upper display portion 391*a* and a lower display portion 391*b*. The upper display portion 391*a* displays the number of copies to be stapled as will be described later. The lower display portion 391*b* displays the total number of copies to be treated. The operation panel 39 is further provided with a stapling copy number setting button 392, a bin designating button 393 and bin buttons 394 having sequential numbers from 1 to 20, that are arranged to correspond to twenty bins 12. The buttons 392, 393 and 394 further include change-over switches and LEDs that are not shown. When the button is pushed, the change-over switch included therein is changed over. The LED is lighted on when the change-over switch is changed to "on," and is lighted off when the change-over switch is "off." Hereinafter, the condition of the button is simply described to be "on" or "off", or "lighted on" or "lighted off".

The stapling copy number setting button 392 is used to determine whether the number of copies to be stapled be set or not in the stapling set mode, as will be described later. When the button 392 is on, the number of copies to be stapled can be set.

The bin designating button 393 can be operated when the stapling copy number setting button 392 is on. When the stapling copy number has been set, the bin designating button 393 can be operated to determine whether the bin on which the papers are to be stapled be designated or not. The bin on which the papers are to be stapled can be designated by the bin button 394 as will be described later.

The RAM 38 includes an area for total copy number X for storing the total number X of copies to be treated, an area for stapling copy number Xs for storing the number Xs of copies to be stapled, a setting button-on flag SRF area, a designation button-on flag SBF area, a bin button-on flag BF(i) (i=1, 2, 3, ..., 20 ) area, an i-register and a j-resister.

FIG. 4-A and Fig- 4-B are a flow chart which illustrates the control operation of the sorter for stapling 10 in the stapling set mode. The stapling set mode is set in the period, for example, from when the power source switch of the sorter for stapling 10 is turned on until when a copy start button of the copying machine body 1 is pushed.

In the staple setting mode, first, the CPU 35 discriminates whether the total number X of copies to be sorted is input or not (step S1). The total number X of copies to be sorted may be input by, for example, pushing the bin button 394 of the operation panel 39 provided for the sorter for stapling 10. Or, when the total number X of copies to be sorted is set on the side of the copying machine body 1, the input may be transmitted from the CPU 36 of the side of the copying machine body 1 to the CPU 35 of the sorter side.

The total number X of copies to be sorted that has been discriminated by the CPU 35 to be input is then written on the area for total number X of copies of the RAM 38 (step S2) and is displayed on the lower display portion 391*b* of the display panel 391 (step S3).

Next, it is discriminated whether the stapling copy number setting button 392 is turned on or not (step S4). When pushed, the stapling copy number setting button 392 that is "on" is detected, the button-on flag SRF for setting the stapling copy number of RAM 38 is set (step S5), and the bin buttons 394 of up to the X-th are lighted on (step S6). For example, when the total number of copies to be treated is X=20, the bin buttons 394 are all lighted on. When the total number of copies to be treated is X=15, the bin buttons "1" to "15" are lighted on. As the bin buttons 394 are turned on, the corresponding bin button-on flags BF (i) (where i=1, 2, ---, X) are also set (step S6).

Then, it is discriminated whether the bin designating button 393 is turned on or not (step S7). When pushed, the bin designating button 393 that is "on" is detected by the CPU 35, and the button-on flag SBF for designating bin is set (step S8).

Thereafter, it is discriminated whether some of the bin buttons 394 that were lighted on at the step S6 are pushed or not (step S9). Upon detecting that some of the lighted-on bin buttons 394 are pushed. The CPU 35 inverts the pushed bin buttons 394 from the lighted-on condition into the lighted-off condition, and resets the corresponding bin button-on flags BF (i) (step S10).

In this embodiment as will be described later, the stapling process is effected for only those papers that are held in the bins 12 corresponding to the bin buttons 394 that are lighted on. Therefore, on condition to the lighted-off condition denote the "bin buttons 394 that correspond to the bins 12 which are not designated".

When the bin buttons 394 that are inverted from the lighted-on condition into the lighted-off condition are pushed again for the purpose of correction or change, the bin buttons 394 are again lighted on and the corresponding bin button-on flags BF (i) are set (step S10).

More specifically, when the total number of copies to be treated is X=20, a pushing of the stapling copy number setting button 392 causes all bin buttons 394 to be lighted on. Then, after the bin designating button 393 has been pushed and lighted on, if any bin button 394 is pushed, the pushed bin button 394 is inverted from the lighted-on condition into the lighted-off condition. Furthermore, if the bin button 394 under the lighted-off condition are pushed again for the purpose of correction or change, this bin button 394 is lighted on.

According to this embodiment as mentioned earlier, the stapling process is effected for only those papers that are held in the bins 12 corresponding to the hight-ed-on bin buttons 394. In the set mode, therefore, optional bin button(s) 394 among the bin buttons 394 are pushed to change them over into the lighted-on condition or the lighted-off condition, so that the stapling process can be effected for only those papers that are held in the desired bins 12.

Thereafter, it is discriminated whether a completion signal is input or not (step S11). When it is discriminated that the completion signal is input, the number of the lighted-on bin buttons 394 or, in other words, the number of bin button-on flags that are set are detected and is stored in the storage area as a stapling copy number Xs(step S12). Further, the number Xs is displayed on the upper display portion 391*a* of the display panel 391, and the process is completed. Here, the completion signal at the step S11 may be a signal that is produced after a predetermined period of time set by the timer has passed or may be a particular signal given from the copying machine body 1.

When the "on" of the bin designating button 393 is not detected at the step S7, the program proceeds to a step S14 where it is discriminated whether some of the bin buttons 394 lighted-on at the step S6 is pushed or not (step S14). When the bin designating button 393 is not pushed (NO at the step S7) and some of the lighted-on bin buttons 394 is pushed (YES at the step S14), only the bin buttons 394 that has been pushed is lighted on but other bin buttons 394 are under lighted-off condition. Further, resetting is effected in all of the bin button-on flags BF(i+1) to BF(X) that have the sequence numbers greater than that of the bin button-on flag BF(i) (i stands for the sequence number of the pushed bin button 394) that corresponds to the pushed bin button 394 (step S15).

Then, the number i of only one lighted-on bin button 394 is stored in the storage area as the stapling copy number Xs (step S16).

The number Xs is displayed on the upper display portion 391*a* of the display panel 391 (step S13).

That is, in the processings at the steps S14, S15 and S16, the sorting bins 12 to be subjected to the stapling process are not arbitrarily selected but the number of stapling process is input and the sequence number of the sorting bin 12 corresponding to the above number is stored.

In the process of FIG. 4-A and FIG. 4-B, when the stapling copy number setting button 392 is not pushed at the step S4, it is discriminated whether the completion signal is input or not (step S17). Then, based on the completion signal which shows, for example, that a predetermined period of time has passed, the total number X of copies to be treated is stored in the storage area as the number Xs of copies to be stapled (S18).

Instead of this embodiment, the invention may be so constituted that the number of copies to be stapled Xs=0 is stored at the step S18 and no stapling process is carried out when there is no signal input.

FIG. 5 is a flow chart which illustrates the control operation of the sorter for stapling 10 in the stapling process mode.

Described below is the control operation in the stapling process mode. In the stapling process mode, first, it is discriminated whether the sorting process is completed or not (step S21) and, if not completed, the completion of the sorting process is waited for.

When it is discriminated that the sorting process is completed, it is discriminated whether the number Xs of copies to be stapled stored in the RAM 38 is "0" or not (step S22). When the number of copies to be stapled is Xs=0, there exists no paper that is to be stapled and hence, the stapling process mode is immediately finished.

When the number of copies to be stapled is not Xs=0, it is first discriminated whether the uppermost portion detection switch 23 (see FIG. 1) is on or not (step S23). Since when the uppermost portion detecting switch 23 is not on, the elevator is not positioned at the uppermost portion, the elevator motor 20 starts to rotate in the reverse direction so that the elevator 15 is positioned at the uppermost portion (steps S23 and S24). When it is discriminated that the uppermost portion detection switch 23 is on, the elevator motor 20 stops (step S25). Then, "1" is set in the i-register and "1" is set in the j-register of the RAM 38, respectively. Then, as will be described later, the condition of the bin button-on flag BF(i) of the sequence number set to the i-register is discriminated, and the corresponding solenoid 14(i) becomes on or off.

Here, symbol i of the i-register represents the order (position) of the bin 12 and symbol j of the j-register represents a number (number of bins) for which the stapling process has been effected.

If specifically described in line with the flow chart, it is first discriminated whether the bin button-on flag BF(1) is set or not (step S27). When the flag BF(1) is set, the papers held in the corresponding bin 12, i.e., in the uppermost bin 12 are the ones that are to be stapled and accordingly, the corresponding solenoid 14(1) is turned on (step S28). Then, the condition of the paper detecting switch 22 is discriminated (step S29), and when the paper detecting switch 22 is on and there are papers held in the bin 12(step S30), the stapler 21 is operated.

After the stapler 21 is operated, the solenoid 14 (1) becomes off (step S31) and the bin button-on flag BF (1) is reset (step S32). Then, the j-register of the RAM 38 is increased by "1" (step S33) and the i-register is also increased by "1" (step S34).

It is then discriminated whether a value j-1 of the j-register has become equal to the number Xs of copies to be stapled or not (step S35). When the value j-1 of the j-register is smaller than the number Xs of copies to be stapled (NO at the step S35), it is discriminated whether the lowermost portion detecting switch 24 is on or not (step S36). With the lowermost portion detecting switch 24 being on, it is not allowed to lower the elevator 15 further, and accordingly, the process is completed.

In the normal processing, the lowermost portion detecting switch 24 is not yet "on" and the process proceeds to a step S37 at which the elevator motor 20 is rotated forward and the elevator 15 moves down. Then, when "off" of the photo-interrupter switch 25 is detected (YES at a step S38) and it is discriminated that the stapler 21 has arrived at a position corresponding to the next bin 12, the elevator motor 20 stops (step S39). Then, it is discriminated whether the next bin button-on flag BF(2) is set or not and, thereafter, the same processing as mentioned above is repeated.

When it is discriminated at the step S27 that the bin button-on flag BF(i) is reset, the process proceeds to the step S34 where the value of the i-register is increased by "1".

When it is discriminated at the step S29 that the paper detecting switch 22 is off, there is no paper that is held in the bin 12, and hence, the process proceeds to the step S32.

Though the above description of the embodiment has dealt with the sorter for stapling that is mounted on a copying machine, it is allowable to mount the sorter for stapling of the present invention even on the image-forming devices such as printers and the like.

The following effects are achieved by the sorter for stapling of the present invention explained above by way of the embodiment.

(1) It is possible to obtain two kinds of papers, i.e., the papers that are only sorted and the papers that are sorted and stapled through one time of processing, the papers which are stapled and the papers which are only sorted being obtained in a condition where the papers are held in the sorting bins. Therefore, these two kinds of documents can be taken out from the sorting bins arranged on one place. This facilitates the take-out operation and eliminates the probability that the papers of either kind are forgotten to be taken out.

(2) Any bins can be designated and the stapling process can be effected for only those papers that are held in the designated bins. This facilitates the use of the device.

(3) The stapling process can be effected by setting the number of bins that are to be subjected to the stapling process. Moreover, the stapling process can be effected by designating the bins that are to be subjected to the stapling process. This facilitates the use of the device to a higher degree.

What we claim is:

1. A sorter for stapling comprising:

a plurality of sorting bins arranged to hold copied papers therein;

a paper guide means which discharges the papers to predetermined bins in response to the setting of a sorting process mode and the number of copies to be sorted;

a stapling means which is capable of being moved to the positions that correspond to the predetermined bins, moves to a position that corresponds to a bin in which are held the papers that are to be stapled, and effects the stapling process under the condition where the papers are held in said bin;

a stapling number setting means that sets the number of bins in which are held the papers to be stapled by said stapling means; and a control means which causes said stapling means to effect the stapling process for only those papers that are held in the bins of a number corresponding to the number of the bins set by said stapling number setting means after the papers have been discharged to said predetermined bins by said paper guide means.

2. A sorter for stapling according to claim 1, wherein said stapling number setting means includes bin buttons of a number equal to the number of said plurality of sorting bins, said bin buttons being arranged to correspond to each of said plurality of sorting bins, and the number of bins in which are held the papers to be stapled is set by pushing the same n-th bin button counted in the order of arrangement of said bin buttons, as the number (n) of the bin to be set.

3. A sorter for stapling according to claim 2, wherein the sequence numbers corresponding to said plurality of sorting bins are given on said bin buttons in the sequence of arrangement of said bins, and the number of bins in which are held the papers to be stapled is set by pushing a bin button having the sequence number corresponding to the number of said bins.

4. A sorter for stapling according to claim 3, wherein said bin buttons include a lighting on/off means that can light said bin button on or off when said bin button is pushed, and the number of bins in which are held the papers to be stapled is set by lighting on a bin button having the same sequence number as said number.

5. A sorter for stapling according to claim 2, wherein said control means causes said stapling means to effect the stapling process for only those papers held in the bins of up to a ordinal number equal to the number of said bins set by said stapling number setting means.

6. A sorter for stapling comprising:

a plurality of sorting bins arranged to hold copied papers therein;

a paper guide means which discharges the papers to predetermined bins in response to the setting of a sorting process mode and the number of copies to be sorted;

a stapling means which is capable of being moved to the positions that correspond to the predetermined bins, moves to a position that corresponds to a bin in which are held the papers that are to be stapled, and effects the stapling process under the condition where the papers are held in said bin;

a stapling bin designating means that designates bins in which are held the papers to be stapled by said stapling means; and a control means which causes said stapling means to effect the stapling process for only those papers that are held in the bin designated by said stapling bin designating means after the papers have been discharged to said predetermined bins by said paper guide means.

7. A sorter for stapling according to claim 6, wherein said stapling bin designating means includes bin buttons of a number equal to the number of said plurality of sorting bins, said bin buttons being arranged to correspond to each of said plurality of sorting bins, and the bin in which are held the papers to be stapled is designated by pushing the bin button that correspond to said bins in which are held the papers that are to be stapled.

8. A sorter for stapling according to claim 7, wherein said bin buttons include a light on/off means that can light said bin button on or off when said bin button is pushed, and the bin in which are held the papers to be stapled is designated by lighting on the bin buttons that correspond to said bins in which are held the papers that are to be stapled.

9. A sorter for stapling comprising:

a plurality of sorting bins arranged to hold papers therein;

a paper guide means which discharges the papers to predetermined bins depending upon a sorting process mode and the number of copies to be sorted;

a stapling means which is capable of being moved to the positions that correspond to the predetermined bins, moves to a position that corresponds to a bin in which are held the papers that are to be stapled, and effects the stapling process under the condition where the papers are held in said bin;

a stapling number setting means that sets the number of bins in which are held the papers to be stapled by said stapling means;

a stapling bin designating means that designates bins in which are held the papers to be stapled by said stapling means; and a control means which selectively causes said stapling means to effect the stapling process for only those papers that are held in the bins of a number corresponding to the number of the bins set by said stapling number setting means or to effect the stapling process for only those papers that are held in the bin(s) designated by said stapling bin designating means after the papers have been discharged to said predetermined bins by said paper guide means.

* * * * *